US009297380B2

(12) United States Patent
Zubenin et al.

(10) Patent No.: US 9,297,380 B2
(45) Date of Patent: Mar. 29, 2016

(54) MULTISTAGE VANE PUMP

(71) Applicant: CLOSED JOINT STOCK COMPANY "NOVOMET-PERM", Perm Permskii krai (RU)

(72) Inventors: Ilya Nikolaevich Zubenin, Perm (RU); Evgeniy Vyacheslavovich Poshvin, Perm (RU); Aleksandr Isaakovich Rabinovich, Perm (RU); Denis Nikolaevich Zubenin, Perm (RU)

(73) Assignee: JOINT STOCK COMPANY "NOVOMET-PERM", Perm Permskii Krai (RU)

( * ) Notice: Subject to any disclaimer, the term of this patent is extended or adjusted under 35 U.S.C. 154(b) by 0 days.

(21) Appl. No.: 14/565,157

(22) Filed: Dec. 9, 2014

(65) Prior Publication Data

US 2015/0167668 A1 Jun. 18, 2015

Related U.S. Application Data

(63) Continuation of application No. 14/373,213, filed as application No. PCT/RU2013/000390 on May 8, 2013, now abandoned.

(30) Foreign Application Priority Data

Apr. 26, 2012 (RU) ..... 2012117392

(51) Int. Cl.
*F04C 11/00* (2006.01)
*F04C 2/356* (2006.01)
(Continued)

(52) U.S. Cl.
CPC ..... *F04C 15/0057* (2013.01); *F01C 21/02* (2013.01); *F01C 21/0827* (2013.01); *F04C 2/3566* (2013.01); *F04C 11/001* (2013.01);
(Continued)

(58) Field of Classification Search
CPC ..... F04C 11/001; F04C 2/356; F04C 11/003; F04C 2/3566
See application file for complete search history.

(56) References Cited

U.S. PATENT DOCUMENTS 791,919 A * 6/1905 Leidy ..... 418/240
2,015,307 A * 9/1935 Hand ..... 418/13
(Continued)

FOREIGN PATENT DOCUMENTS

GB 1246091 A * 9/1971
WO WO 9408139 A1 * 4/1994 ..... F04C 2/356
WO WO 2005010367 A1 * 2/2005 ..... F04C 2/00

*Primary Examiner* — Mary A Davis
(74) *Attorney, Agent, or Firm* — Notaro, Michalos & Zaccaria P.C.

(57) ABSTRACT

A multi-stage vane-type positive displacement pump used for lifting fluid from oil wells has stages disposed on a common shaft. Each stage has a rotor, a stator, separating vanes, working chambers, a lower cap with inlet ports, and an upper cap with outlet ports. The rotor is in the form of a cam. The stator is formed from two concentric sleeves situated on a base and having an annular gap therebetween. Slots are provided in the inner sleeve and in the base for the movement of the vanes. The vanes are connected to one another by a synchronizing element. The ports are situated opposite the chambers, either side of the vanes. The end faces of the caps of adjacent stages are conjoined to form an annular cavity, which communicates with the gap of the preceding stage. The aim is to increase the reliability of the pump, to simplify the design and to reduce the manufacturing cost thereof while enabling the pumping of fluids with a high content of abrasive particles.

8 Claims, 3 Drawing Sheets

(51) Int. Cl.
*F04C 15/00* (2006.01)
*F01C 21/08* (2006.01)
*F01C 21/02* (2006.01)

(52) U.S. Cl.
CPC ..... *F04C 11/003* (2013.01); *F04C 2240/30* (2013.01)

(56) References Cited

U.S. PATENT DOCUMENTS 2,475,391 A * 7/1949 Johnson ..... 418/240
2,492,687 A * 12/1949 Dall ..... 418/39

* cited by examiner

MULTISTAGE VANE PUMP

CROSS-REFERENCE TO RELATED APPLICATIONS

This is a continuation application of U.S. patent application Ser. No. 14/373,213 filed Jul. 18, 2014, which is a 371 application of PCT/RU2013/000390 filed May 8, 2013, which are both incorporated herein by references, and which claims priority on Russian Patent Application No. 2012117392 filed Apr. 26, 2012, which priority claim is repeated here.

TECHNICAL FIELD

The invention relates to the mechanical engineering, namely to the multistage vane type volumetric pumps, which can be used for lifting the liquid out of oil wells.

PRIOR KNOWLEDGE

The vane pump is known having a housing-stator with radial slots in which the separation plates are diametrically placed with possibility of a reciprocating movement, and the cam-rotor, concentrically installed in the housing-stator space with the ability to interact with the plates and form the working chambers, alternately communicated with the suction and discharge ports, at that the pump is equipped with an additional body, covering the housing-stator with the formation of an circular forcing clearance, in which a spring ring with the possibility of interaction with plates is placed [Patent for the utility model No. 11273 RF, F04C2/28, publ. 16 Sep. 1999]. The presence of the spring ring in such pump prevents seizure of the plates when abrasive particles get into the clearance between the stator slots and plates during operation. When working in abrasive environment, uniform wear of the end faces of the plates occurs associated with the fact that the plates make only linear movement.

However, the design of the pump provides no possibility to be executed in stepped version.

The closest to the invention by the technical nature and the achieved effect is a multistage vane pump, including consistently placed on a common shaft stages, containing the rotor installed with the possibility of axial movement on the shaft, the stator, working chambers between the rotor and stator, separation plates, moving in the slots located in the longitudinal central plane, the bottom cover with input apertures and the top cover with output apertures. The internal surface of the stator is formed by two pairs of symmetrically arranged arcs of different radii and smooth transition areas from the arcs of a larger radius to the arcs of a smaller radius. Each stage is equipped with a safety valve to discharge excess pressure and seal. The covers are fixed on the stator with the placement of at least two apertures opposite the smooth transition areas of the internal surface of the stator [Patent No 2395720 RF, F04C2/344, publ. 27 Jul. 2010].

This pump has the following disadvantages when working in abrasive environment:

1. The clearances between the rotor slots and plates can be clogged with abrasive particles, thereby seizer of the plates is possible, especially at small outer diameters of the pump when the centrifugal forces can not be enough to move the plates out of the rotor.

2. Increased wear of the end faces of the plates, associated with the fact that the plates in addition to the linear movement also make radial movement together with the rotor, besides due to contact with the upper or lower cover the plates bend in the slots of the rotor within the clearance of the slot.

3. The high cost of the pump is due to the necessity of the manufacturing of the plates, stator, rotor, and covers from a hard alloy.

The objective of the invention is to increase the reliability of the pump, simplify design and reduce its cost, when pumping liquids with a high content of abrasive particles.

SUMMARY OF THE INVENTION

The specified technical result is achieved by the fact that according to the invention in the multistage vane pump, which includes the stages consistently placed on a common shaft, containing the rotor installed with the possibility of axial movement on the shaft, the stator, working chambers between the rotor and stator, separation plates, moving in the slots arranged in the longitudinal central plane, the bottom cover with input apertures and the top cover with the output apertures, the rotor is made in the form of a cam, the stator is formed of two concentric bushes and the base with the formation of the circular clearance, the slots are made in the inner bush and base, separation plates are connected by synchronizing element, and the input and output apertures in the covers of the stage are located in front of its working chambers on different sides of separation plates, wherein the end faces of the covers of adjoining stages are connected with the formation of the circular space which communicates with the circular clearance of the previous stage.

As a synchronizing element a metal or an elastic ring can be used as well as springs can be installed at each of the separation plate.

To compensate radial loads in each subsequent stage the rotor can be rotated 180° around its geometrical axis, and stators are arranged sequentially without turns. For full compensation of radial loads at this arrangement of rotors and stators at least two stages are necessary. Radial loads can be compensated also in the case if the stators of adjoining stages are turned around each other for 90°, while the rotors are placed sequentially on the shaft without turns. With this arrangement of stages the full compensation of radial loads will require a minimum of 4 stages.

To increase wear resistance radial bearings can be installed between stages or between series of stages, thereby radial loads are compensated and a constant clearance between the rotors and stators are ensured.

Increase of wear resistance is also supported by an additional installation the axial bearings between stages or between series of stages, compensating radial loads generated by the stages, and the axial load effecting on the shaft, but herewith axial clearance between the rotors and axial bearing should be absent. Thus there is a constant clearance between the stators and the end covers.

BRIEF DESCRIPTION OF THE DRAWINGS

The nature of the invention is illustrated by drawings, where.

REDUCTION OF THE INVENTION

Figure 2:
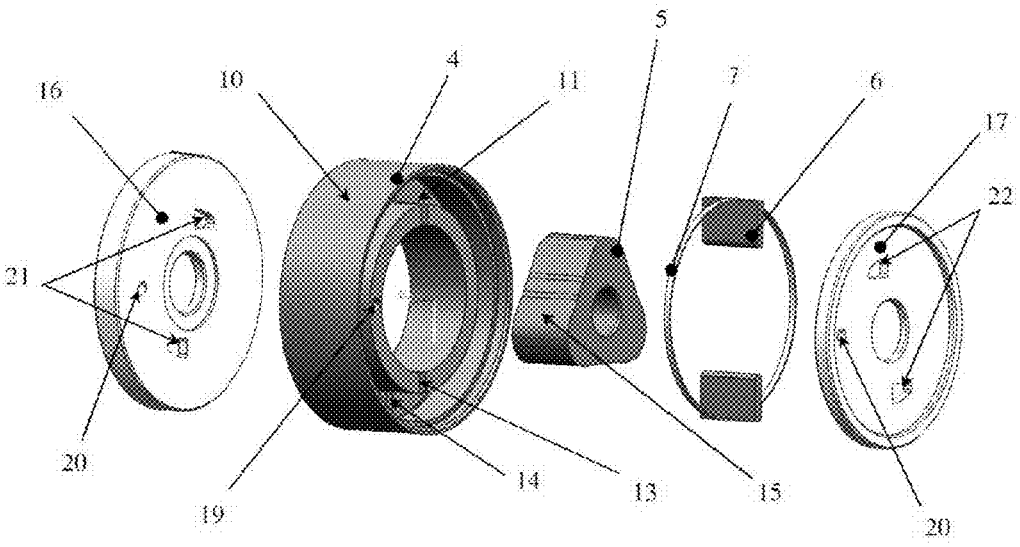
FIG. 2 is a separated view of the pump stage.
Figure 3:
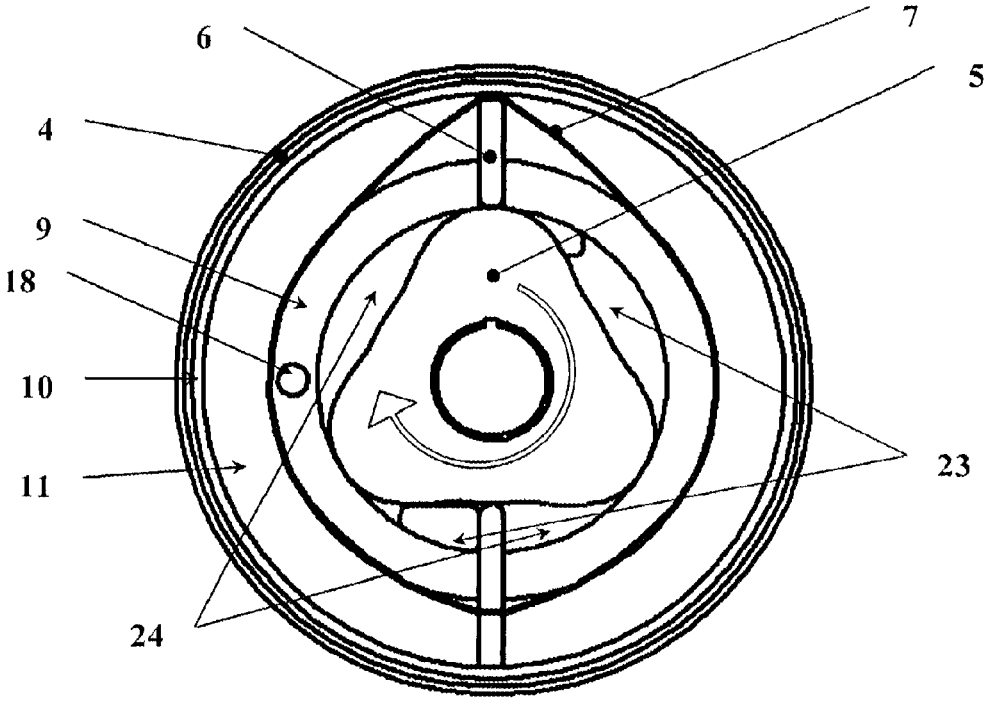
FIG. 3 shows the pump stage on the output side without the top cover.
Figure 4:
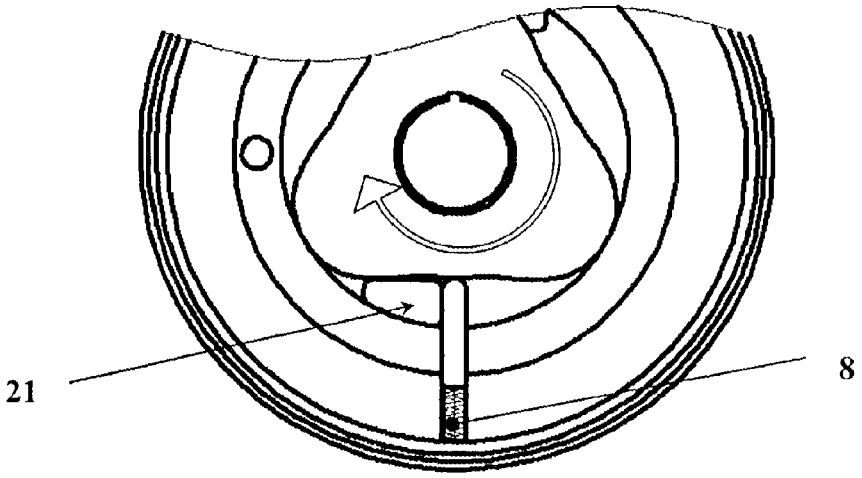
FIG. 4 shows the pump stage with springs as a synchronizing element.

The multistage vane pump (FIG. 1) consists of stages (1), consequently arranged on a common shaft (2). To increase wear resistance radial bearings (3), compensating radial loads and shaft deflection (2) can be additionally installed between stages (1) or between series of stages. Each stage (1) of the pump contains the stator (4), the rotor (5), diametrically located separation plates (6), interconnected by synchronizing element (7) for example by metal (FIG. 2) or elastic (FIG. 3) ring. The springs (8) at each separation plate (FIG. 4) can be installed as a synchronizing element. The stator (4) is formed of two concentric bushes (9) and (10) located on the base (11) and forming the circular clearance (12) between them, in which there is a synchronizing element (7). The inner bush (9) has radial slots (13), changing into slots (14) on the base (11), where the separation plates (6) are inserted. The rotor (5) is made in the form of a cam with a profiled outer surface (15). The bottom (16) and the top (17) covers are rigidly installed at the end faces of the stator (4), separation plates (6) and the rotor (5) against axial movement. Fixation of covers can be made, for example, by a pin (18) passing through the holes (19) in the stator (4) and in covers (20). The input apertures (21) are on the bottom cover (16) and the output apertures (22) are on the top cover (17). The working chambers of suction (23) and forcing (24) are formed between the inner bush (9), profiled outer surface (15) and separation plates (6). The apertures are placed in close proximity to the separation plates (6), input apertures (21)—opposite the working chambers of suction (23), output apertures (22)—opposite the working chambers of forcing (24) (FIG. 4). The covers (16) and (17) of the adjoining stages are connected with the formation of circular space (25), which communicates with the circular clearance (12) of the previous stage.

Figure 1:
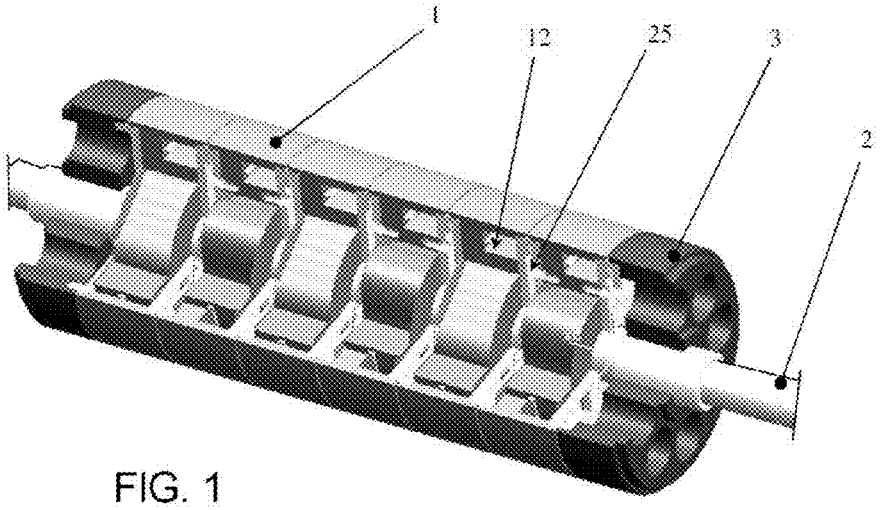
FIG. 1 shows the claimed multistage vane pump with rotors turned around for 180°, ¾ section.

To compensate radial loads the rotor (5) of each subsequent stage (1) is installed with turn of 180° around its geometrical axis (FIG. 1). As an alternative variant of this problem solution the stators (4) of the adjoining stages (1) can be turned against each other for 90 degrees and the rotors (5) can be placed consecutively without turns.

Figure 5:
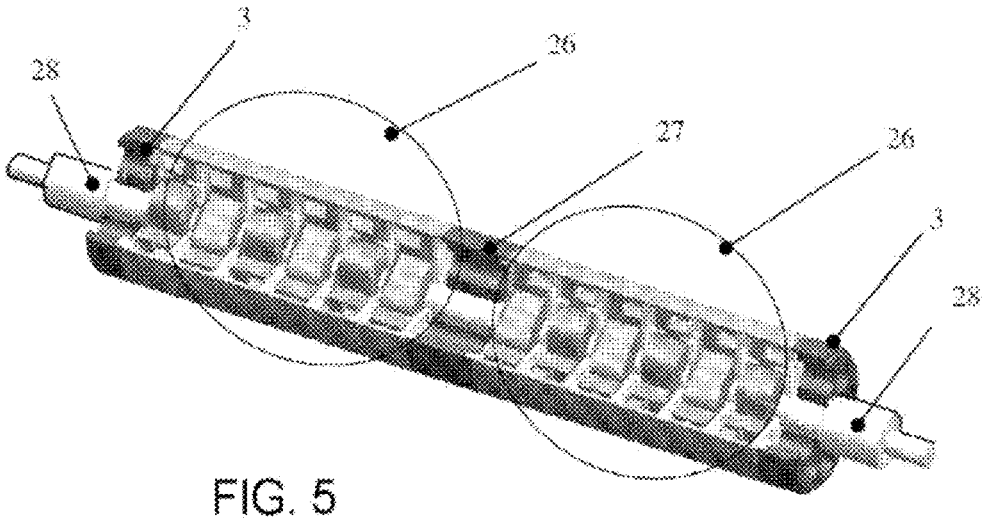
FIG. 5 is an isometric of ¾ section of the claimed vane pump with intermediate and axial bearings.
Figure 6:
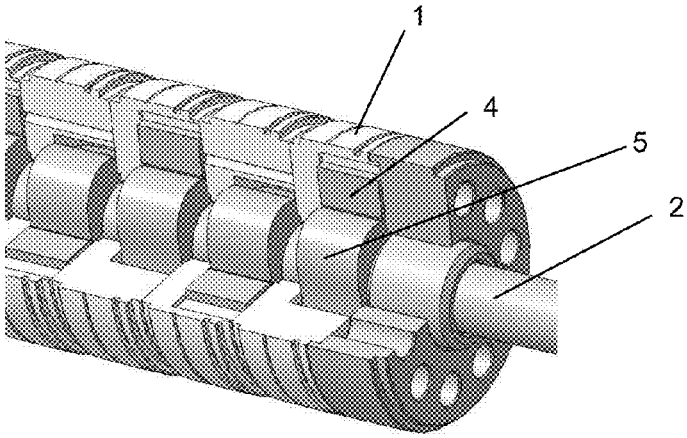
FIG. 6 is a partial, ¾ sectional view of the present multistage vane pump showing the stator of adjoining stages turned against each other for 90° and the respective rotors are placed sequentially on the common shaft without turns.

To increase wear resistance the axial bearings (28) without axial clearance relative to the rotor (5) (FIG. 5) are additionally installed between stages (1) or between series of stages (26).

Multistage vane pump works as follows.

During the rotation of the shaft (2) of the rotor (5) the separation plates (6) slide on its profiled surface (15) and on both sides of the plate (3) the working chambers (23) and (24) of variable volume are formed, alternately reported with input apertures (21) in the bottom cover (16) and output apertures (22) in the top cover (17). Upon rotation of the rotor (5) according to the arrow indicated on FIGS. 3 and 4, the chamber volume (23) increases resulting in the induction of the working medium and the chamber volume (24) decreases, due to which the working medium is pushed out into a circular space (25) between the top cover (17) and the bottom cover (16) of the next stage.

Further, the working medium enters the next stage (1) and partially returned into the buffer space formed by the circular clearance (12) in the stator (4) and the top cover (17). When interacting with the projection of the rotor (5) the separating plate (6) moves along the slot (14) in the base (11), recess into the slot (13) and presses on to the synchronizing ring (7), which pushes the diametrically located plate (6) to the rotor (5). Thanks to this, moving plates out is made mechanically and ensures a constant contact of plates (6) with rotor (5), and particles got into the clearance between the stator slots (13) and plates (6), are pushed out or worn by plates (6), that prevents them from seizing.

In the buffer place the working medium presses on plates (6), thereby pressing them to the profiled surface (15) of the rotor (5) and discharging synchronizing ring (7). The rotor (4) of the subsequent stage is rotated on 90°, and the process of extrusion of a working medium of the previous stage coincides with the process of absorption in the subsequent stage, thus the radial loads in the stages are partially compensated.

For full compensation of radial loads between stages (1) or series of stages (26) intermediate radial bearings are installed (27).

Thus, the proposed design has high reliability due to the fact that the plates are constantly pressed against the rotor, making only the linear movement, the rotor does not touch the stator and the stages assembly provides hydraulic unloading the pump elements. The synchronizing ring prevents seizing of the plates when mechanical impurities get into the clearance between the stator and the plate. Reliability of the construction work does not depend on external diameter. High production effectiveness, serviceability and low cost are provided due to a small number of parts and ease of their manufacture. In addition, the simplicity of the parts form facilitates strengthening of friction surfaces, for example, by methods of hardening or spraying of hard alloys and allows using hard alloys, ceramics, carbides of silicon or silicified graphite for their manufacture, which eventually increases the wear resistance of the pump when working in abrasive environments.

The invention claimed is:

1. A multistage vane pump, including a plurality of stages consistently placed on a common shaft;

each stage comprising a rotor capable of axial movement on the common shaft, and a stator;

a plurality of working chambers formed by the rotor, the stator, and separation plates;

a bottom cover has input apertures and a top cover has output apertures;

wherein the rotor is formed in the shape of a cam, wherein the stator is formed by an inner bush and an outer bush that are concentric with one another, the inner and outer bushes are connected by a base with an annular clearance formed between them, wherein slots are located in the longitudinal central plane and made in the inner bush and the base, wherein separation plates move within the slots and are connected by a synchronization element, and wherein the input and output apertures in the bottom and top covers, respectively are formed adjacent the working chambers on different sides of the separation plates, and wherein the ends of the bottom and top covers of adjacent stages are conjoined and form a circular space, which communicates with the annular clearance of the previous stage.

2. The multistage vane pump according to claim 1 is distinguished that a metal ring is used as the synchronization element.

3. The multistage vane pump according to claim 1 is distinguished that elastic rings are used as the synchronization element.

4. The multistage vane pump according to claim 1 is distinguished that springs are installed as the synchronization element.

5. The multistage vane pump according to claim 1 is distinguished that radial bearings are installed between the plurality of stages or between series of stages.

6. The multistage vane pump according to claim 1 further comprises axial bearings without axial clearance relative to the rotor that are installed between the plurality of stages or series of stages.

7. The multistage vane pump according to claim 1 is distinguished that in each subsequent stage the rotor is turned on 180° about its geometrical axis, and the respective stator is placed sequentially without turns.

8. The multistage vane pump according to claim 1 is distinguished that the stator stators of adjoining stages are turned against each other for 90° and the respective rotors are placed sequentially on the common shaft without turns.

* * * * *